US006078271A

United States Patent [19]

Roddy et al.

[11] Patent Number: 6,078,271

[45] Date of Patent: Jun. 20, 2000

[54] MULTIPLE-FREQUENCY PROGRAMMABLE TRANSMITTER

[75] Inventors: Timothy S. Roddy, Plymouth; Joseph D. King, Ann Arbor, both of Mich.

[73] Assignee: Lear Automotive Dearborn, Inc., Southfield, Minn.

[21] Appl. No.: 09/027,323

[22] Filed: Feb. 20, 1998

[51] Int. Cl.[7] ..... G08C 19/00

[52] U.S. Cl. ..... 340/825.72; 340/825.69; 340/825.31; 340/825.34

[58] Field of Search ..... 340/825.69, 825.72, 340/825.31, 825.22, 825.32, 426, 539, 825.73; 455/352, 151.2; 341/176; 348/734; 343/771

[56] References Cited

U.S. PATENT DOCUMENTS

| | | | |
|---|---|---|---|
| 5,442,340 | 8/1995 | Dykema | 30/82.22 |
| 5,479,155 | 12/1995 | Zeinstra et al. | 340/825.22 |
| 5,583,485 | 12/1996 | Van Lente et al. | 340/825.69 |
| 5,614,891 | 3/1997 | Zeinstra et al. | 340/825.22 |
| 5,661,804 | 8/1997 | Dykema et al. | 380/21 |
| 5,680,134 | 10/1997 | Tsui | 340/825.31 |
| 5,686,903 | 11/1997 | Duckworth et al. | 340/825.72 |
| 5,699,055 | 12/1997 | Dykema et al. . | |
| 5,717,410 | 2/1998 | Ohmine et al. | 343/771 |

FOREIGN PATENT DOCUMENTS

WO/94/02920 2/1994 WIPO .

*Primary Examiner*—Howard L. Williams
*Assistant Examiner*—Jean B. Jeanglaude
*Attorney, Agent, or Firm*—Brooks & Kushman P.C.

[57] ABSTRACT

A programmable transmitter includes a receiver for receiving a coded signal at a desired frequency. The code is stored in memory during a learning mode and is then retransmitted sequentially at a plurality of frequencies, including said desired frequency. During this time, the operator observes the device to be operated and indicates to the transmitter when the controlled device performs the desired function, i.e., when the desired frequency is transmitted. At that time, the operator presses a button on the transmitter, and the transmitter stores the most recently transmitted frequency.

22 Claims, 2 Drawing Sheets

MULTIPLE-FREQUENCY PROGRAMMABLE TRANSMITTER

BACKGROUND OF THE INVENTION

The present invention relates generally to programmable transmitters and more particularly to a simplified multi-frequency programmable transmitter.

Universally programmable transmitters provide a convenient means for operating several remote control systems with a single multi-function transmitter. All-in-one, programmable, infrared remote controls for TVS, VCRs, and stereos combine the functions of several remote control systems into one transmitter. Similarly, radio frequency (RF) remote control systems, such as garage door openers, security lighting, estate gates, and alarm systems may all be operated with one remote control that has the capability of learning and duplicating the RF messages used by various brands and models of systems. Additionally, transmitters for garage door and/or home access/security/lighting, can be built into the interior of an automobile making them more secure and less obtrusive.

The circuitry and operating methods currently used in universal RF transmitters are quite complex. One example is a method that reproduces a signal copied from another transmitter by learning the frequency and digital data of the signal during programming. This requires very sophisticated electronics for finding and then reproducing the frequency of the learned signal. Another method requires that the user identify the brand and/or model of the garage door opener to be controlled, and then set miniature switches in the transmitter to the positions specified in a programming booklet. These and other similar solutions can be expensive and/or confusing for the user.

SUMMARY OF THE INVENTION

The inventive programmable transmitter greatly simplifies and reduces the cost of implementing a universal RF transmitter. The programmable transmitter includes one or more pushbuttons, corresponding to transmitter channels that can be individually programmed to operate different garage door openers, home access, remote control lighting devices, vehicle access/alarm, or any other types of RF remote control systems, each having a unique code and potentially a unique frequency.

The programmable transmitter is placed in a learning mode by a specifically defined action, such as pressing and holding one or more pushbuttons for several seconds. If there is more than one channel, the button of the channel to be programmed is then pressed briefly. In the learning mode, the programmable transmitter learns digital data (the "code") from the user's original system transmitter. Learning is preferably implemented through a very rudimentary receiver detector that is capable of receiving radio signals over a wide range of frequencies. During this learning process, there is no need to know or find the exact frequency of the original system transmitter being copied. The original transmitter is placed within a few inches of the programmable transmitter, so that the signal is strong compared to any other stray signals in the frequency range.

After the code is stored in the memory of the programmable transmitter, the device begins a trial "sequential frequency hopping" process to determine the carrier frequency of the system to be controlled. The code captured during programming is sequentially transmitted at predetermined carrier frequencies with a time delay between transmissions. The predetermined frequencies preferably include those known to be most common for the intended use(s) (garage door openers, home access, remote control lighting systems, vehicle access/alarm, or any other type of RF remote control systems). Generation of the carrier frequencies is accomplished through selectable control of a) a programmable multi-frequency transmitter; b) several single frequency transmitters; or c) a combination of a) and b).

When the user observes activation of the intended device or system, any button on the programmable transmitter is pressed, within a predetermined time, to complete the programming operation. The frequency (or some indicator of the frequency) last selected at the time of the user's response is then stored in the memory of the programmable transmitter. In use, operation of the pushbutton for each programmed channel will result in the stored data being transmitted at the appropriate selectable frequency.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF A PREFERRED EMBODIMENT

Figure 1:
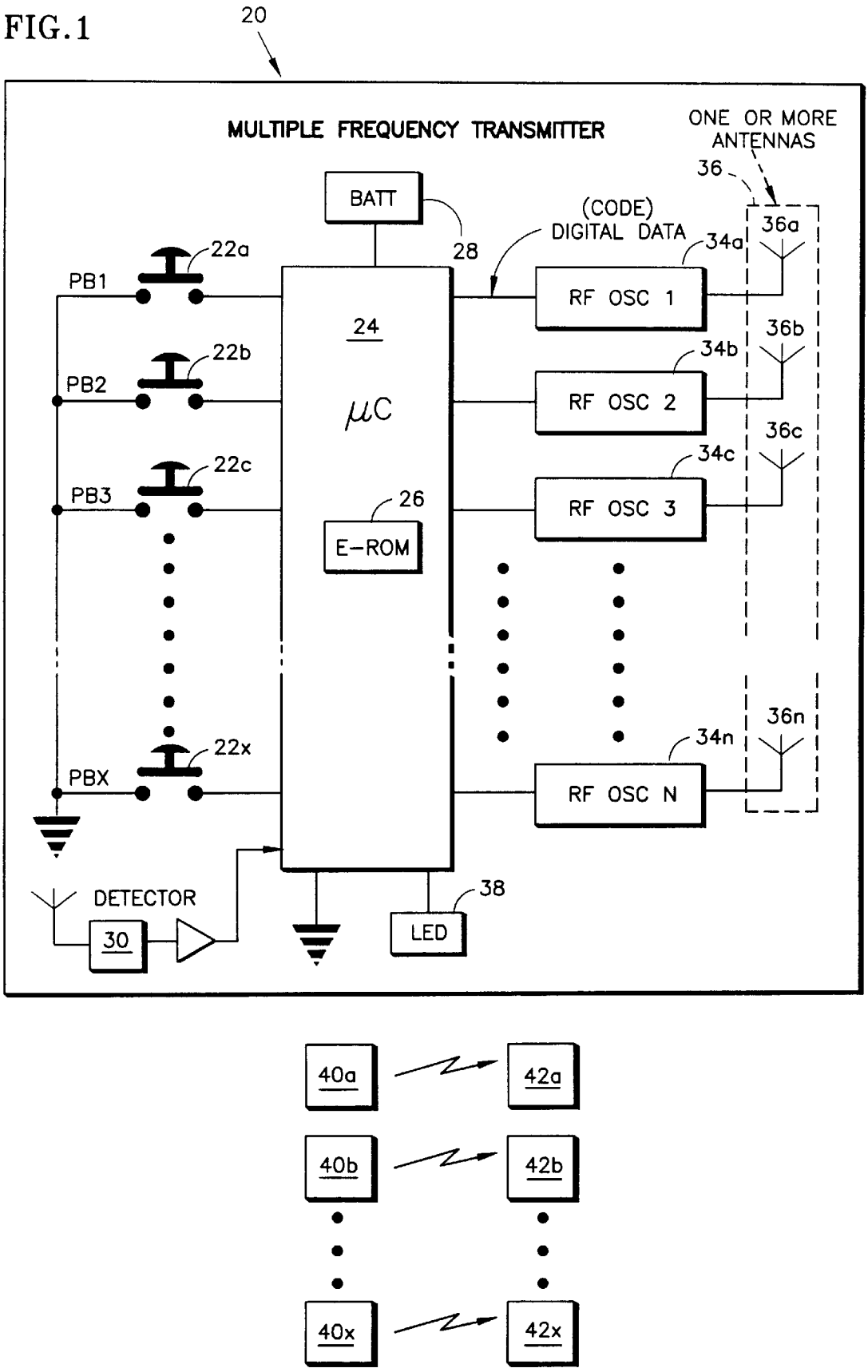
FIG. 1 is a schematic of the programmable transmitter of the present invention.

A programmable transmitter 20 is shown in FIG. 1 having a plurality of user operable switches 22*a–x* connected to a microcontroller 24. The microcontroller 24 preferably includes a memory 26, such as electrically erasable read-only memory, and is powered by a self-contained battery or from a vehicle's battery 28. A RF receiver 30 is preferably a wide-range or frequency-independent receiver which receives signals over a wide range of frequencies utilized by radio frequency remote control systems, such as garage door openers, security lighting, estate gates, and alarm systems, etc. Preferably this frequency range includes 290 Mhz–400 Mhz, but is extendable to microwave frequencies. Most preferably the receiver 30 is a detector. The receiver may also be a wideband receiver, channelized receiver or compressive receiver.

The programmable transmitter 20 further includes an RF oscillator 34, which may comprise a plurality of RF oscillators 34*a–n*, each operable at a specified carrier frequency receivable by the RF receiver 30. The RF oscillators 34 each operate at a frequency which is common to RF controlled devices, such as 300 Mhz, 310 Mhz and 390 Mhz. Components of the RF oscillators 34*a–n* may be shared among the oscillators 34, such that the RF oscillator 34 can selectively produce any one of a plurality of discrete frequencies. The RF oscillators 34 are connected to a transmitting antenna 36, which may comprise a plurality of antennae 36*a–n*, or a single antenna 36. The programmable transmitter 20 preferably includes an indicator, which may be audible or visible, and is preferably at least one LED 38.

The programmable transmitter 20 can be programmed and then utilized to replace a plurality of RF transmitters 40*a–x* which each operate an RF-controlled device 42*a–x* having a complementary receiver, such as garage door opener, security lighting, estate gates or alarm system, etc. Each of the transmitters 40*a–x* to be replicated transmits a different code and may transmit at a different frequency. When one of the transmitters 40 transmits the proper code at the desired frequency, the associated controlled device 42 performs the desired function, such as opening the garage door opener, turning on lights, opening a gate or disabling/enabling an alarm system, etc. Some of the transmitters 40 may comprise more than one button on a single transmitter, in which case different codes will be transmitted, most likely at a common frequency, to cause the controlled device 42 to perform different functions.

Figure 2:
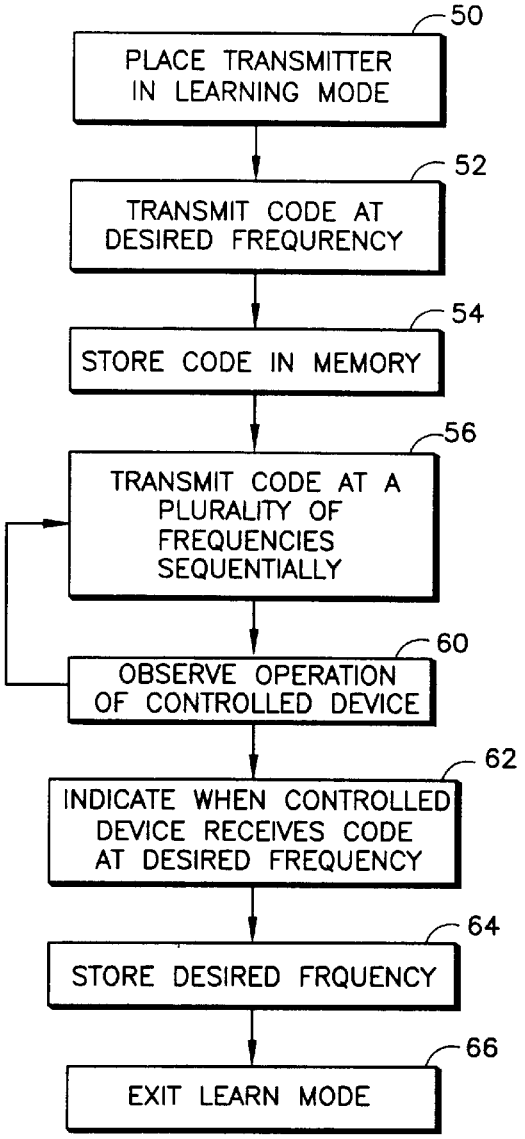
FIG. 2 is a flow chart illustrating the method of programming the programmable transmitter of the present invention.

Programming and operation of the programmable transmitter 20 will be described with respect to FIGS. 1 and 2. Referring to FIG. 2, the programmable transmitter 20 is first placed in "learning" mode in step 50 by depressing one of the user operable switches 22 for a predetermined length of time. Alternatively, a combination of switches 22 may place the transmitter 20 into learning mode, after which the switch 22 to be programmed is depressed briefly. When the programmable transmitter 20 is set to the learning mode, the indicator 38 blinks slowly to prompt the user to activate the original transmitter 40. If a transmitted signal is not recognized within a predetermined time (15–30 seconds), the learning mode is terminated and the indicator 38 is extinguished. In step 52, one of the original transmitters 40 is placed a few inches away from the programmable transmitter 20. The code for the original transmitter 40 is then transmitted at the desired frequency in step 52.

In step 54, the transmitter 20 receives the code with receiver 30 and stores the code in memory 26 using any one of commonly known or proprietary algorithms. At this time, the programmable transmitter 20 "knows the code" to be associated with the specific user switch 22, but not the desired frequency. When the programmable transmitter 20 has learned the code, the indicator 38 steadily illuminates for a predetermined time. This pause allows a reasonable time for the user to recognize that learning is done, and to stop activation of the original transmitter 40, thus avoiding interference with the trial transmission process. This pause also allows the user to wait for the controlled device 42 to finish any operation that occurred due to activation of the original transmitter 40 (i.e., wait for a door or gate to stop moving).

The programmable transmitter 20 proceeds to step 56 after a fixed pause. Alternatively, within a predetermined time, the user must again press the switch 22 of the switch 22 being programmed to proceed to step 56; otherwise the learning mode terminates and the indicator 38 is extinguished. Alternatively, within a predetermined time, the user presses the switch 22 being programmed to start step 56; otherwise the step 56 begins automatically. Alternatively, the programmable transmitter 20 determines when the original transmitter 40 has stopped transmitting and automatically starts step 56 after a fixed pause.

In step 56, the microcontroller 24 sends the code to each of the RF oscillators 34*a–n* sequentially, separated by a time delay to allow the user time to respond. The indicator 38 flashes rapidly for a short time to show when a trial transmission is occurring. This will help the user know when to look for a response from the intended receiving device 42. Each of the RF oscillators 34*a–n* transmits the code, while the operator observes the operation of the control device in step 60. After each trial transmission in step 56, the indicator 38 blinks slowly for a predetermined time (5–15 seconds), while waiting for the user's response (any button pushed) to a successful trial transmission (activation of intended receiving device).

When the code is transmitted at the desired frequency (i.e. the frequency of the original transmitter 40 being duplicated), the user observes the intended operation of the controlled device 42 in step 60 and indicates that the desired frequency was transmitted in step 62 by depressing any of the switches 22. Alternatively, the user can hold the switch 22 to be programmed until operation of the controlled device 42 is observed, at which time the switch 22 is released. An indicator of the oscillator 34*a–n* that last transmitted at the time of the user's response in step 62 is stored in the memory 26 in step 64 and associated with the programmed switch 22 and its associated code. Preferably, a portion of the memory 26 stores a code and a frequency associated with each of the switches 22*a–x*. The learning mode is then exited in step 66 and the indicator 38 is extinguished.

Subsequently, during use after programming, when the user switch 22 is activated, the code stored in memory 26 associated with the switch 22 is transmitted at the desired frequency by the associated RF oscillator 34 for that frequency. The code is then received at the desired frequency by the controlled device 42 and performs the desired function. The other switches on the programmable transmitter 20 are programmed in the same method. Notably, each of the switches 22 can be associated with a different code and/or different frequency, such that the programmable transmitter 20 can replace a plurality of original transmitters 40 for a variety of different devices 42.

In an alternative embodiment, the RF transmitters 34 simultaneously or sequentially transmit the learned code at their respective frequencies, without ever learning the frequency of the original transmitter. For example, since most garage door openers operate at one of only three frequencies, only three RF transmissions would be required for such operation.

Figure 3:
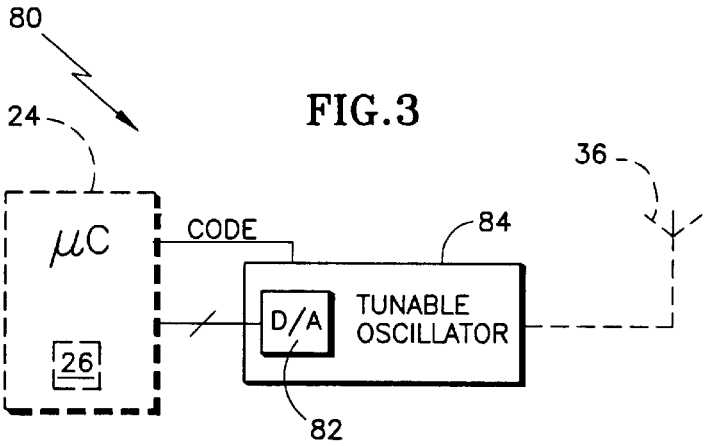
FIG. 3 is an alternative embodiment of the oscillator of FIG. 1.

An alternative, tunable RF oscillator 80, such as a voltage controlled oscillator, is shown in FIG. 3, which can be used in place of the RF oscillators 34 of FIG. 1. The tunable RF oscillator 80 preferably includes a digital to analog converter 82 which receives from the microcontroller 24 data representing a frequency stored in memory 26 associated with one of the switches 22. That frequency data is converted to an analog voltage signal which operates the tunable oscillator 84. The tunable RF oscillator 84 also receives the associated code from the microcontroller 24 and memory 26. The tunable RF oscillator 84 then generates the specified code at the specified frequency via the antenna 36.

The versatility of the programmable transmitter 20 can be further enhanced by including preprogrammed codes, rolling code "keys," and any encryption code (such as algorithms and seed numbers) with associated frequency selection information, preprogrammed selections can be assigned to user switches for operating devices that are designed to "learn" these codes. Newer garage door openers with "rolling code" security are an example of this type of device. A button on the in-home control unit is pressed to initiate a "program mode." The in-home unit is then ready to learn special rolling code "keys" from preprogrammed transmitting devices. Another type of receiver, that is used to control devices throughout the home via the house wiring, also learns preprogrammed fixed codes from RF transmitters.

The programmable transmitter 20 of the present invention utilizes a simplified and lower cost circuitry for implementing a universal RF transmitter. Further, programming of the programmable transmitter is easier than known programmable transmitters. It should be recognized that the transmitter could be realized in many forms, including but not limited to, portable, pocket, or key chain configurations, as well as built-in or detachable units for vehicle use. It should also be noted that the programmable transmitter 20 is not limited to RF frequencies but could also be utilized for microwave frequencies or other frequency bands as well.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A programmable transmitter having an assertable switch, the programmable transmitter comprising:

a receiver operative to resolve a code in a received signal that has a frequency that is unresolved by the receiver but is one of a plurality of preselected frequencies;

a memory operative to program the transmitter by storing the code;

a transmitter operative, upon assertion of the switch, to transmit the code stored in said memory at each of the plurality of preselected frequencies.

2. The programmable transmitter of claim 1, wherein said transmitter transmits the code stored in said memory at each of said plurality of frequencies sequentially.

3. The programmable transmitter of claim 2, wherein said programmable transmitter further including a switch for selecting one of said plurality of frequencies sequentially transmitted by said transmitter, said transmitter stores said selected frequency, and said transmitter transmits said code at said selected frequency upon later activation of said transmitter by said user.

4. The programmable transmitter of claim 3 wherein said switch selects a most recently transmitted frequency of said plurality of frequencies.

5. The programmable transmitter of claim 3, wherein said switch is a user-activatable switch.

6. The programmable transmitter of claim 3, wherein said transmitter comprises a plurality of oscillators each generating one of said plurality of frequencies.

7. The programmable transmitter of claim 3, wherein said transmitter comprises a tunable oscillator sequentially generating said plurality of frequencies.

8. The programmable transmitter of claim 3, wherein said receiver is a detector.

9. The programmable transmitter of claim 3, further including a learn mode selected by a user, said receiver storing said code in said memory only in said learn mode.

10. The programmable transmitter of claim 1, wherein said transmitter transmits the code stored in said memory at each of said plurality of frequencies simultaneously.

11. A method for programming a transmitter having a memory and an assertable switch, the method including the steps of:

(a) placing the transmitter in a learn mode;

(b) transmitting a code at a desired frequency from a different transmitter to the transmitter;

(c) programming the transmitter by storing the code in the memory; and (d) upon assertion of the switch transmitting said code from said transmitter at a plurality of preselected frequencies including said desired frequency, without the transmitter resolving the desired frequency.

12. The method of claim 11 wherein said plurality of frequencies are transmitted simultaneously in said step (c).

13. The method of claim 11 wherein said plurality of frequencies are transmitted sequentially in said step (c).

14. The method of claim 13 further including the step of:

(d) indicating to said transmitter when said code is transmitted at said desired frequency.

15. The method of claim 14, further including the step of storing said desired frequency on said transmitter.

16. The method of claim 14, further including the step of transmitting said plurality of frequencies, including said desired frequency, sequentially from a plurality of oscillators on said transmitter.

17. The method of claim 14, further including the step of tuning a tunable oscillator sequentially to each of said plurality of frequencies, during said step (c).

18. The method of claim 14, further including the step of observing a device to be controlled by said transmitter during said step (c) and wherein said indication in said step (d) is based upon said observation of said device.

19. A programmable transmitter having a learn mode and an operating mode comprising:

a plurality of user-input switches;

a receiver operative to resolve codes in received signals at any of a plurality of frequencies without resolving the frequency of a received signal;

a memory operative to store said codes received by said receiver and associating each said code with one of said user-input switches;

a transmitter operative to transmit each said code stored in said memory at each of said plurality of frequencies sequentially and associating a most recently transmitted frequency of said plurality of frequencies with each said code upon receiving a feedback signal; and said transmitter being further operative to transmit one of said codes at its associated frequency upon activation of said associated user-input switch.

20. The programmable transmitter of claim 19, wherein said feedback signal is a user feedback signal.

21. The programmable transmitter of claim 19, further including a plurality of oscillators each generating one of said plurality of frequencies.

22. The programmable transmitter of claim 19, further including a learn mode selected by a user, said receiver storing said codes in said memory only in said learn mode.

* * * * *